US008878746B2

(12) United States Patent
Lock et al.

(10) Patent No.: US 8,878,746 B2
(45) Date of Patent: Nov. 4, 2014

(54) MULTI-SCREEN ELECTRONIC DEVICE WITH MECHANISM FOR TRANSITIONING BETWEEN COMPACT AND EXPANDED FORMS

(75) Inventors: William Edward Lock, Horseheads, NY (US); Donnell Thaddeus Walton, Painted Post, NY (US); Kevin Lee Wasson, Elmira, NY (US); Todd Marshall Wetherill, Painted Post, NY (US)

(73) Assignee: Corning Incorporated, Corning, NY (US)

( * ) Notice: Subject to any disclaimer, the term of this patent is extended or adjusted under 35 U.S.C. 154(b) by 786 days.

(21) Appl. No.: 13/033,068

(22) Filed: Feb. 23, 2011

(65) Prior Publication Data

US 2012/0212397 A1 Aug. 23, 2012

(51) Int. Cl.
*G09G 5/00* (2006.01)
*G09G 3/20* (2006.01)

(52) U.S. Cl.
CPC ..... *G09G 3/20* (2013.01); *G09G 2300/026* (2013.01)
USPC ..... 345/1.3

(58) Field of Classification Search
None
See application file for complete search history.

(56) References Cited

U.S. PATENT DOCUMENTS

| | | | | |
|---|---|---|---|---|
| 5,494,447 | A * | 2/1996 | Zaidan | 439/31 |
| 6,262,885 | B1 * | 7/2001 | Emma et al. | 361/679.05 |
| D618,683 | S | 6/2010 | Wilson et al. | |
| 2005/0041012 | A1 * | 2/2005 | Daniel et al. | 345/156 |
| 2005/0237269 | A1 * | 10/2005 | Connor et al. | 345/1.3 |
| 2005/0285811 | A1 * | 12/2005 | Kawase et al. | 345/1.1 |
| 2006/0012951 | A1 * | 1/2006 | Kim | 361/681 |
| 2006/0082518 | A1 * | 4/2006 | Ram | 345/1.1 |
| 2006/0166713 | A1 * | 7/2006 | Yeh et al. | 455/575.1 |
| 2007/0001927 | A1 * | 1/2007 | Ricks et al. | 345/1.1 |
| 2009/0034173 | A1 * | 2/2009 | Shaum | 361/681 |
| 2010/0035669 | A1 | 2/2010 | Jang et al. | |
| 2010/0053081 | A1 | 3/2010 | Jee et al. | |
| 2010/0056224 | A1 | 3/2010 | Kim | |
| 2010/0075717 | A1 | 3/2010 | Ou | |
| 2011/0176260 | A1 * | 7/2011 | Walters et al. | 361/679.01 |
| 2011/0216483 | A1 * | 9/2011 | Vesely | 361/679.01 |
| 2011/0299235 | A1 * | 12/2011 | Liu et al. | 361/679.09 |

FOREIGN PATENT DOCUMENTS

WO WO 2008030563 A2 * 3/2008

OTHER PUBLICATIONS

Spring, OLPC Announces Next-Gen XO-2 $75 Laptop, May 20, 2008, http://blogs.pcworld.com/staffblog/archives/006986.html.*

* cited by examiner

*Primary Examiner* — Alexander S Beck
*Assistant Examiner* — Kirk Hermann
(74) *Attorney, Agent, or Firm* — Timothy M Schaeberle

(57) ABSTRACT

A multi-screen electronic device includes a first electronic device having a first electronic device screen and a second electronic device having a second electronic device screen. The first and second electronic device screens are stacked and on different planes when the multi-screen electronic device is in a compact form. The first and second electronic device screens are unstacked and on the same plane when the multi-screen electronic device is in an expanded form. A translation mechanism is coupled to the first and second electronic devices. The translation mechanism is configured to guide a motion of at least one of the first and second electronic devices along a nonlinear path such that a travel along the nonlinear path in a forward direction transforms the multi-screen electronic device from the compact form to the expanded form and a travel along the nonlinear path in a reverse direction transforms the multi-screen electronic device from the expanded form to the compact form.

18 Claims, 7 Drawing Sheets

MULTI-SCREEN ELECTRONIC DEVICE WITH MECHANISM FOR TRANSITIONING BETWEEN COMPACT AND EXPANDED FORMS

TECHNICAL FIELD

The present invention relates to an electronic device having at least two screens, where one of the at least two screens can be selectively exposed or hidden.

BACKGROUND

U.S. Patent Publication No. 2010/007517 A1 (Ou; published 25 Mar. 2010) discloses a dual-screen electronic device having a first screen that folds or tilts relative to a second screen. U.S. Patent Publication No. 2010/0056224 (Kim; published 4 Mar. 2010) discloses a dual-screen electronic device having a first screen that slides relative to a second screen. U.S. Patent Publication No. 2010/0035669 A1 (Jang et al.; published 11 Feb. 2010) discloses a dual-screen electronic device having a first screen that slides and pivots relative to a second screen.

SUMMARY

In one aspect, the invention relates to a multi-screen electronic device that includes a first electronic device having a first electronic device screen and a second electronic device having a second electronic device screen. The first and second electronic device screens are stacked and on different planes when the multi-screen electronic device is in a compact form. The first and second electronic device screens are unstacked and on the same plane when the multi-screen electronic device is in an expanded form. The multi-screen electronic device further includes a translation mechanism coupled to the first and second electronic devices. The translation mechanism is configured to guide a motion of at least one of the first and second electronic devices along a nonlinear path such that a travel along the nonlinear path in a forward direction transforms the multi-screen electronic device from the compact form to the expanded form and a travel along the nonlinear path in a reverse direction transforms the multi-screen electronic device from the expanded form to the compact form.

In one embodiment, the first electronic device has a first electronic device body, and the first electronic device screen is mounted on a frontside of the first electronic device body. Also, the second electronic device has a second electronic device body, and the second electronic device screen is mounted on a frontside of the second electronic device body.

In one embodiment, the first electronic device further includes an additional first electronic device screen mounted on a backside of the first electronic device body. Also, the second electronic device further includes an additional second electronic device screen mounted on a backside of the second electronic device body.

In one embodiment, the additional first and second electronic device screens are stacked and on different planes when the multi-screen electronic device is in the compact form. Also, the additional first and second electronic device screens are unstacked and on the same plane when the multi-screen electronic device is in the expanded form.

In one embodiment, the additional first and second electronic device screens provide a double-sized screen when the multi-screen electronic device is in the expanded form.

In one embodiment, the first and second electronic device screens provide a double-sized screen when the multi-screen electronic device is in the expanded form.

In one embodiment, the translation mechanism is selected from the group consisting of a sliding mechanism, a pivoting mechanism, and a pulley mechanism.

In one embodiment, the sliding mechanism includes a guide channel formed in the first electronic device body and a guide tab formed on the second electronic device body, where the guide tab is adapted to slide along the guide channel.

In one embodiment, the guide channel defines the nonlinear path.

In one embodiment, the guide channel has three guide channel portions providing three different motion directions.

In one embodiment, the pivoting mechanism includes a pair of parallel linkages coupled to a side of the first and second electronic devices bodies via rotary joints.

In one embodiment, the pivoting mechanism further includes means for locking the pair of parallel linkages together when the multi-screen electronic device is in the compact form or expanded form.

In one embodiment, the pivoting mechanism includes an additional pair of linkages coupled to another side of the first and second electronic device bodies via rotary joints.

In one embodiment, the pivoting mechanism further includes means for locking the additional pair of linkages together when the multi-screen electronic device is in the compact form or expanded form.

In one embodiment, the pulley mechanism includes a pair of wheels coupled to a side of the first and second electronic bodies via rotary joints, a rigid arm coupled to and linking the pair of wheels, and a belt looped over the pair of wheels.

In one embodiment, the rigid arm traces an arc as the multi-screen electronic device is transformed from the compact form to the expanded form or from the expanded form to the compact form.

In one embodiment, the pulley mechanism further includes an additional pair of wheels coupled to a side of the first and second electronic bodies via rotary joints, an additional rigid arm coupled to and linking the additional pair of wheels, and an additional belt looped over the additional pair of wheels.

In one embodiment, the first electronic device body has a recess for receiving the second electronic device when the multi-screen electronic device is in the compact form.

In one embodiment, the multi-screen electronic device further includes a port formed on one of the first and second electronic devices and a connector formed on the other of the first and second electronic devices. The port and connector are adapted to mate to form at least one of a data connection and power connection between the first and second electronic devices when the multi-screen electronic device is in the expanded form.

In one embodiment, each of the first and second electronic device screens is selected from the group consisting of a display screen, an input screen, a touch screen, and any combination of the preceding.

It is to be understood that both the foregoing general description and the following detailed description are exemplary of the invention and are intended to provide an overview or framework for understanding the nature and character of the invention as it is claimed. The accompanying drawings are included to provide a further understanding of the invention and are incorporated in and constitute a part of this specification. The drawings illustrate various embodiments of the invention and together with the description serve to explain the principles and operation of the invention.

BRIEF DESCRIPTION OF THE DRAWINGS

The following is a description of the figures in the accompanying drawings. The figures are not necessarily to scale, and certain features and certain views of the figures may be shown exaggerated in scale or in schematic in the interest of clarity and conciseness.

DETAILED DESCRIPTION

Additional features and advantages of the invention will be set forth in the detailed description that follows and, in part, will be readily apparent to those skilled in the art from that description or recognized by practicing the invention as described herein.

Figure 1:
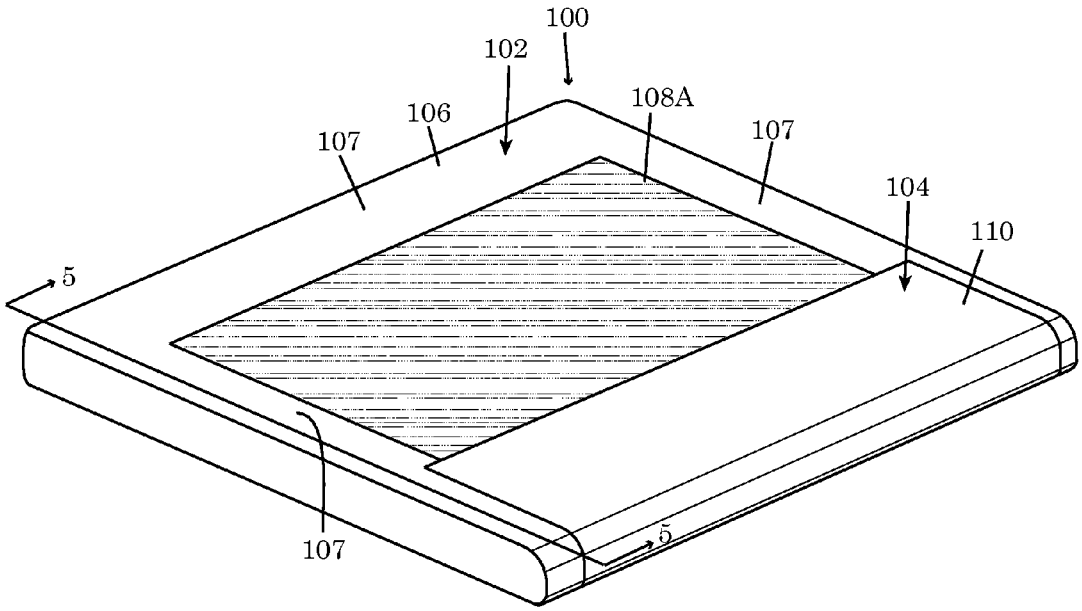
FIG. 1 is a perspective view of a frontside of a multi-screen electronic device in a compact form.
Figure 3:
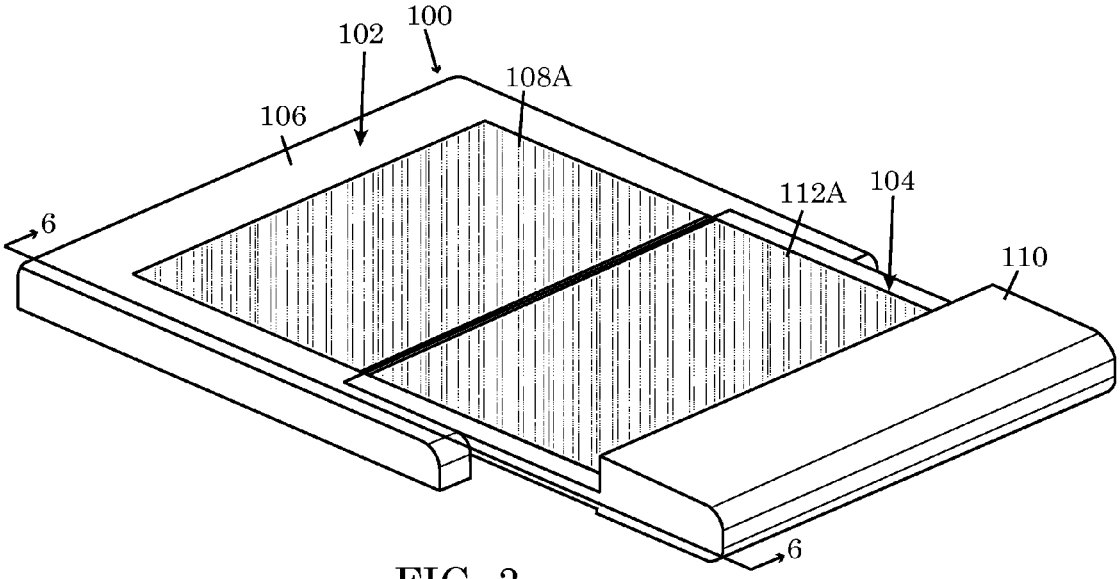
FIG. 3 is a perspective view of a frontside of a multi-screen electronic device in an expanded form.

FIGS. 1 and 3 show a multi-screen electronic device 100 according to one embodiment of the invention. The multi-screen electronic device 100 has a compact form, as shown in FIG. 1, and an expanded form, as shown in FIG. 3. The multi-screen electronic device 100 may function as, for example, a general purpose computer that allows several applications to run on different screens simultaneously, an electronic book reader, a presentation device that allows an audience to sit directly opposite the presenter, a delivery tracking device, a meter reading device, a combined phone and computer device, and a game computer that allows a first competitor to sit directly opposite a second competitor. In FIG. 3, the multi-screen electronic device 100 has a primary electronic device 102 and a secondary electronic device 104. The primary electronic device 102 can function independently of the secondary electronic device 104. The secondary electronic device 104 may function independently of or depend partly on the primary electronic device 102. When the multi-screen electronic device 100 is in the compact form, as shown in FIG. 1, the primary electronic device 102 is stacked on the secondary electronic device 104. When the multi-screen electronic device 102 is in the expanded form, as shown in FIG. 3, the primary electronic device 102 is not stacked on and is beside the secondary electronic device 104.

The primary electronic device 102 has a primary electronic device front screen (108A in FIG. 1 or 3) and a primary electronic device back screen (108B in FIG. 2) mounted on a primary electronic device body 106. The primary electronic device 102 may employ any suitable flat electronic visual display technology for the screens, such as liquid crystal display technology or organic light emitting diode display technology. The screens 108A, 108B may each be a display screen, an input screen, a touch screen, or any combination of the preceding. The electronic components of the primary electronic device 102 are disposed in the primary electronic body 106. Details of these electronic components will not be shown or discussed because they do not constitute novel or inventive aspects of the present invention and because they will change depending on the intended use of the primary electronic device 102. The primary electronic device front screen 108A is exposed when the multi-screen electronic device 100 is in either the expanded form or the compact form. The primary electronic device back screen 108B is exposed when the multi-screen electronic device 100 is in the expanded form and hidden when the multi-screen electronic device 100 is in the compact form.

The secondary electronic device 104 has a secondary electronic device front screen (112A in FIG. 3 or 4A) and a secondary electronic device back screen (112B in FIG. 4B) mounted on a secondary electronic device body 110. The secondary electronic device 104 may employ any suitable flat electronic visual display technology for the screens, such as liquid crystal display technology or organic light emitting diode display technology. The screens 112A, 112B may each be a display screen, an input screen, a touch screen, or any combination of the preceding. The electronic components of the secondary electronic device 104 are disposed in the secondary electronic device body 110. For the same reason stated above, details of these electronic components will not be shown or discussed. The secondary electronic device front screen 112A is hidden when the multi-screen electronic device 100 is in the compact form and exposed when the multi-screen electronic device 100 is in the expanded form. The secondary electronic device back screen 112B is exposed when the multi-screen electronic device 100 is in either the expanded form or the compact form.

In one embodiment, the primary electronic device body 106 provides a protective edge band (107 in FIG. 1) around the outer edges of each of the primary electronic device screens 108A, 108B. Also, the secondary electronic device body 110 provides a protective edge band (111 FIG. 4A) around the outer edges of each of the secondary electronic device screens 112A, 112B. Protective edge paddings are not provided at the inner edges of the primary electronic device screens 108A, 108B and the secondary electronic device screens 112A, 112B. These inner edges meet when the multi-screen electronic device 100 is in the expanded form. The meeting inner edges allow double-sized screens to be formed when the multi-screen electronic device 100 is in the expanded form. In FIG. 3, screens 108A, 112A form a double-sized screen. The secondary electronic device body 110 also provides a handle 113 (in FIG. 4A) that a user may grab to move the secondary electronic device body 110 relative to the primary electronic device body 106. The primary electronic device body 106 and secondary electronic device body 110 may be molded plastic bodies or housings. Alternatively, the primary electronic device body 106 and the secondary electronic device body 110 may be made from other materials, such as aluminum, and by other methods besides molding, such as machining.

Figure 2:
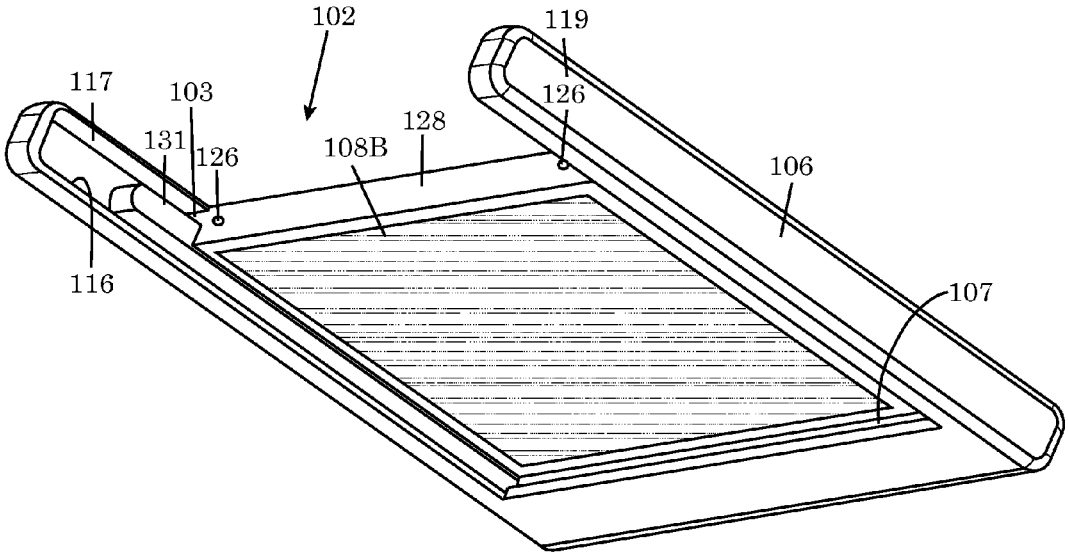
FIG. 2 is a perspective view of a backside of a primary electronic device.

FIG. 2 shows a view of a backside of the primary electronic device body 106. In this backside view, opposite side edges (only one side edge is generally indicated at 103; the other side edge cannot be indicated because of the orientation of the drawing) of the primary electronic device 102 are sandwiched between opposing side walls 117, 119 of the primary electronic device body 106 and a pair of supports 131 (only one support 131 is visible because of the orientation of the drawing) formed on the side walls 117, 119. The primary electronic device body 106 has a recess 107 sized to receive the secondary electronic device 104 (in FIG. 4A). When the multi-screen electronic device 100 (in FIG. 1) is in the compact form, the secondary electronic device 104 is retracted into the recess 107 of the primary electronic device body 106. In the compact form, the primary electronic device back screen 108B and the secondary electronic device front screen 112B (in FIG. 4A) oppose each other and are hidden inside the multi-screen electronic device 100. As shown in FIG. 3, the secondary electronic device 104 can be pulled out of the recess 107 (in FIG. 2). In the expanded form, such as shown in FIG. 3, all the screens of the multi-screen electronic device 100 are exposed.

In the compact form of the multi-screen electronic device 100, as shown in FIG. 1, the primary electronic device 102 and the secondary electronic device 104 (in FIG. 3) are stacked. The stacking is such that the secondary electronic device front screen 112A (in FIG. 3) is hidden behind the primary electronic device 102, is on a different plane than the plane of the primary electronic device front screen 108A, is in opposing relation to the primary electronic device back screen 108B (in FIG. 2), and is unexposed and unusable. In addition, the secondary electronic back screen 112B (in FIG. 4B) is exposed and usable, is in opposing relation to the primary electronic device front screen 108A, and is on a different plane than the plane of the primary electronic device front screen 108A. In the expanded form of the multi-display electronic 100, as shown in FIG. 3, the secondary electronic device 104 and the primary electronic device 102 are unstacked. The unstacking is such that the secondary electronic device front screen 112A is beside the primary electronic device front screen 108A, is on the same plane as the primary electronic device front screen 108A, and is exposed and usable. In addition, the secondary electronic device back screen 112B is beside the primary electronic device back screen 108B, is exposed and usable, and is on the same plane as the primary electronic device back screen 108B. In the expanded form, the primary and secondary electronic device front screens 108A, 112A provide a double-sized screen and the primary and secondary electronic device back screens 118B, 112B provide a double-sized screen.

The multi-screen electronic device 100 includes a translation mechanism for stacking and unstacking the primary electronic device 102 and secondary electronic device 104. In one embodiment, the translation mechanism guides motion of at least one of the primary electronic device 102 and secondary electronic device 104 in a forward direction along a nonlinear path such that the primary and secondary electronic devices 102, 104 are unstacked, thereby placing the multi-screen electronic device 100 in an expanded form, and in a reverse direction along the nonlinear path such that the primary and secondary electronic devices 102, 104 are stacked, thereby placing the multi-screen electronic device 100 in a compact form.

Figure 4A:
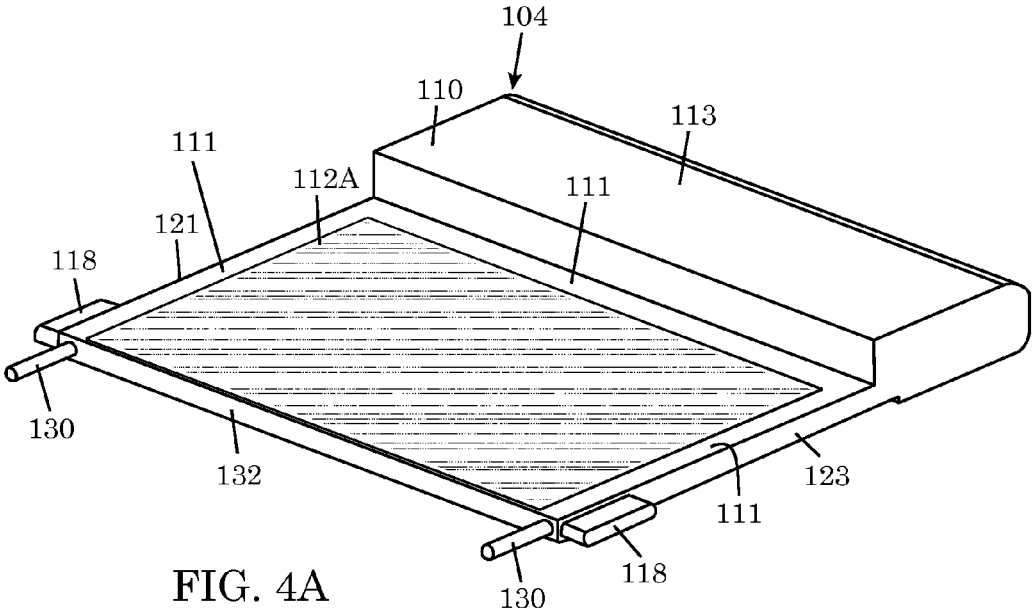
FIG. 4A is a perspective view of a frontside of a secondary electronic device.
Figure 5:
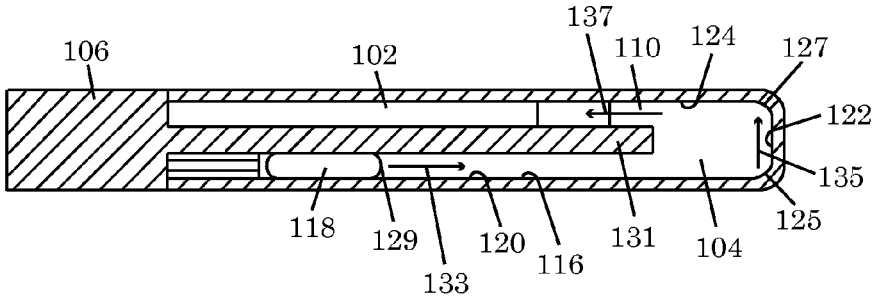
FIG. 5 is a cross-section of FIG. 1 along line 5-5.

In FIG. 2, in one embodiment, the translation mechanism includes a pair of guide channels 116 formed in the opposing side walls 117, 119 of the primary electronic device body 106 (only the guide channel 116 formed in the side 117 is visible because of the orientation of the drawing). In FIG. 4A, in one embodiment, the translation mechanism also includes a pair of guide tabs 118 attached to or formed on opposite sides 121, 123 of the secondary electronic device body 110. The guide tabs 118 are arranged on the periphery of the secondary electronic device body 110 so that they can engage with and slide along the guide channels (116 in FIG. 2), as shown in FIG. 5. The guide tabs 118 can rest on the supports (131 in FIG. 2), as shown in FIG. 6, when the primary and secondary electronic devices 102, 104 are unstacked.

In FIG. 5, each of the guide channels 116 has a first guide channel portion 120 corresponding to a first portion of the nonlinear path, a second guide channel portion 122 corresponding to a second portion of the nonlinear path, and a third guide channel portion 124 corresponding to a third portion of the nonlinear path. The first guide channel portion 120 and the third guide channel portion 124 are parallel to each other, and the second guide channel portion 122 is transverse to both the first guide channel portion 120 and the third guide channel portion 124. The corners 125, 127 between the guide channel portions 120, 122 and 122, 124, respectively, may be rounded. Also, at least the leading ends 129 of the guide tabs 118 may be rounded so that they conform to the rounded corners 125, 127 as they transition between the guide channel portions 120, 122 and 122, 124.

To unstack the primary and secondary electronic devices 102, 104 (i.e., transform the multi-screen electronic device 100 from the compact form to the expanded form), referring to FIG. 5, the guide tabs 118 are translated along the first guide channel portions 120 in the direction indicated by arrow 133, then along the second guide channel portions 122 in the direction indicated by arrow 135, then along the third guide channel portions 124 in the direction indicated by arrow 137. To stack the primary and secondary electronic devices 102, 104 (i.e., transform the multi-screen electronic device 100 from the expanded form to the compact form), referring to FIG. 6, the guide tabs 118 are translated along the third guide channel portions 124 in the direction indicated by the arrow 139, then along the second guide channel portions 122 in the direction indicated by the arrow 141, then along the first guide channel portions 120 in the direction indicated by the arrow 143. Translation of the secondary electronic device 104 along the guide channels 116 may be done manually by a user. It may also be possible to attach motors to the guide tabs 118 that will propel the secondary electronic device 104 along the guide channels 116. The motors may be energized by issuing a command to the multi-screen electronic device 100. For example, a button on the primary electronic device 102 may be used to provide the command to energize the motors. A spring may also be provided to assist in motion of the guide tabs 118 along the guide channel portions 122, i.e., to pop the guide tabs 118 along the direction indicated at 135 (in FIG. 5). It is also possible to reverse the position of the guide channels 116 and guide tabs 118, e.g., with the guide channels being formed on the secondary electronic device body 110 and the guide tabs being formed on the primary electronic device body 106. In this case, the primary and secondary electronic devices 102, 104 will be stacked or unstacked by moving the primary electronic device 102 along the nonlinear path.

Figure 4B:
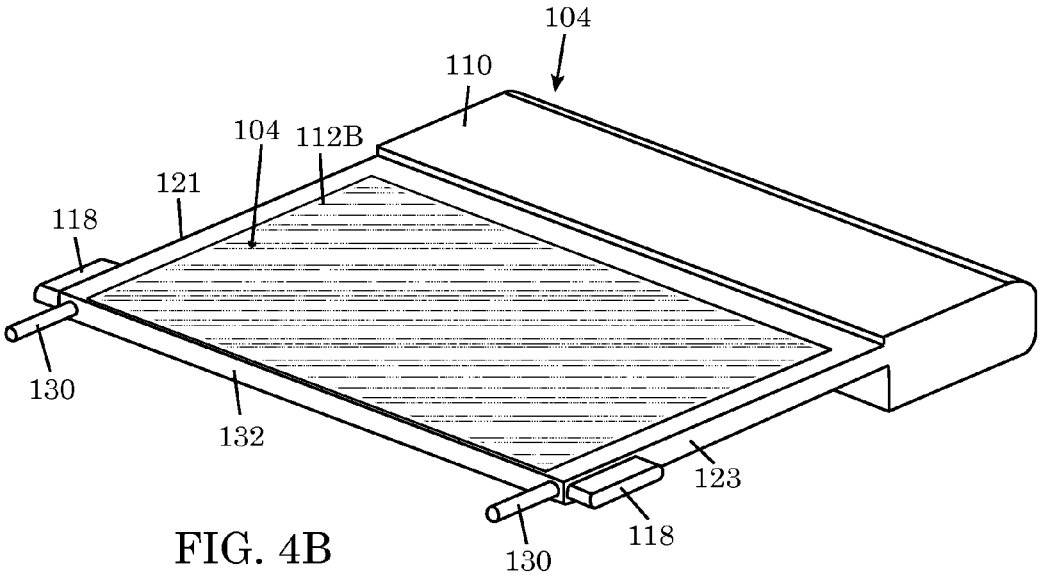
FIG. 4B is a perspective view of a backside of a secondary electronic device.
Figure 6:
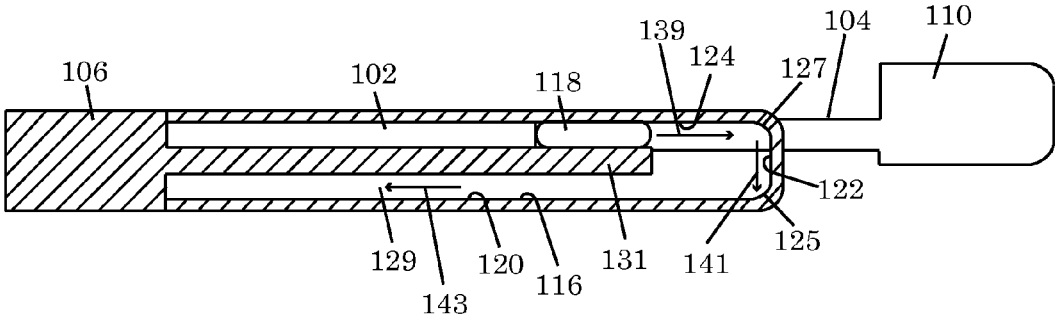
FIG. 6 is a cross-section of FIG. 3 along line 6-6.

The secondary electronic device 104 can be docked to the primary electronic device 102 for power and/or data communication when the primary and secondary electronic devices 102, 104 are unstacked and the multi-screen electronic device 100 is in the expanded form, as shown in FIG. 3 or 6. For docking, in one embodiment, as shown in FIG. 2, ports 126 are formed on an edge 128 of the primary electronic device 102. In FIG. 4A or 4B, connectors 130 are formed on an edge 132 of the secondary electronic device 104. When the primary and secondary electronic devices 102, 104 are unstacked and the multi-screen electronic device 100 is in the expanded form, the connectors 130 are inserted into the ports 126 to form a power connection and/or data connection between the devices 102, 104. Thus, unstacking the primary and secondary electronic devices 102, 104 (or transforming the multi-screen electronic device 100 from the compact form to the expanded form) also includes, in one embodiment, forming a power connection and/or data connection between the primary and secondary electronic devices 102, 104. In one embodiment, the power connection and/or data connection are broken when the primary and secondary electronic devices 102, 104 are stacked back again (i.e., when the multi-screen electronic device is transformed from the expanded form back to the compact form). The primary and secondary electronic devices 102, 104 may also have their own batteries and communicate wirelessly, thereby eliminating the need for physical electrical connections between the devices.

Figure 7A:
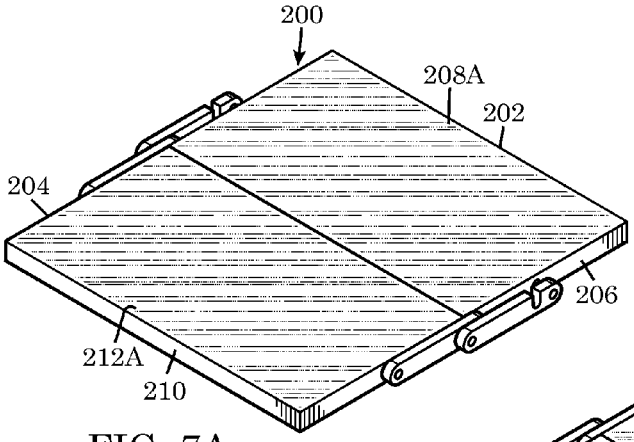
FIG. 7A is a perspective view of a frontside of a multi-screen electronic device in an expanded form.

FIGS. 7A-7D show a multi-screen electronic device 200 according to another embodiment of the invention. As in the case of the previously described multi-screen electronic device 100, the multi-screen electronic device 200 may function as, for example, a general purpose computer that allows several applications to run on different screens simultaneously, an electronic book reader, a presentation device that allows an audience to sit directly opposite the presenter, a delivery tracking device, a meter reading device, a combined phone and computer device, and a game computer that allows a first competitor to sit directly opposite a second competitor. In FIG. 7A, the multi-screen electronic device 200 has a primary electronic device 202 and a secondary electronic device 204. The primary electronic device 202 has a primary electronic device front screen 208A and a primary electronic device back screen 208B (in FIG. 7B) mounted on opposite sides of a primary electronic device body 206. Similarly, the secondary electronic device 204 has a secondary electronic device front screen 212A and a secondary electronic device back screen 212B (in FIG. 7B) mounted on a secondary electronic device body 210. The primary and secondary electronic devices 202, 204 may have any of the characteristics described above for the primary and secondary electronic devices 102, 104 (in FIG. 1 or 3).

Figure 7B:
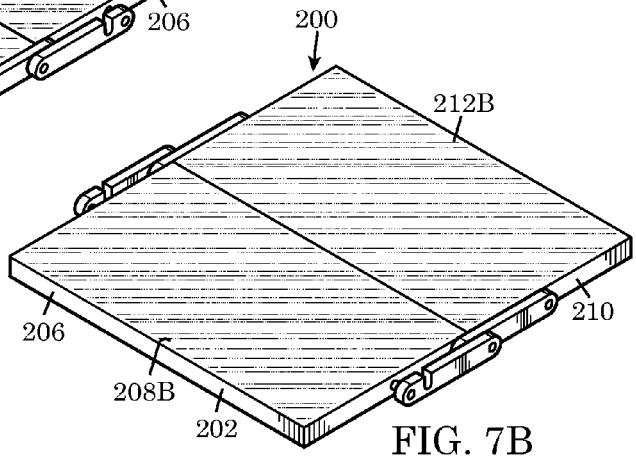
FIG. 7B is a perspective view of a backside of a multi-screen electronic device in an expanded form.

The multi-screen electronic device 200 differs from the previously described multi-screen electronic device 100 (in FIG. 1 or 3) in that the primary and secondary electronic device bodies 206, 210 do not provide protective edge bands 117 (in FIG. 1), 111 (in FIG. 4A) around the outer edges of the screens 208A, 208B, 212A, 212B (in FIGS. 7A and 7B). However, in alternate embodiments, the primary and secondary electronic device bodies 206, 210 could be modified to provide protective edge bands, similar to the protective edge bands 117, 111, around the outer edges of the screens 208A, 208B, 212A, 212B. Also, the multi-screen electronic device 200 differs from the previously described multi-screen electronic device 100 in the translation mechanism that transforms the multi-screen electronic device 200 from the compact form to the expanded form, or vice versa.

Figure 7C:
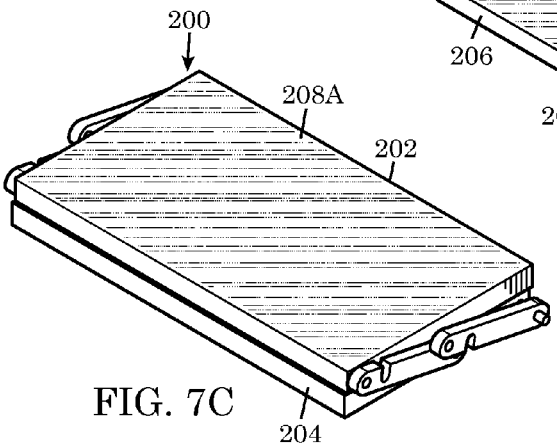
FIG. 7C is a perspective view of a frontside of a multi-screen electronic device in a compact form.

When the multi-screen electronic device 200 is in the expanded form, as shown in FIG. 7A or 7B, all the screens 208A, 208B, 212A, 212B of the primary and secondary electronic devices 202, 204 are exposed and usable. Also, in the expanded form, the screens 208A, 212A are on the same plane and form a double-sized screen and the screens 208A, 212B are on the same plane and form a double-sized screen. When the multi-screen device 200 is in the compact form, as shown in FIG. 7C, the primary electronic device front screen 208A and the secondary electronic device back screen 212B (which is on the backside of the multi-screen electronic device 200) are exposed and usable, while the primary electronic device back screen 208B and the secondary electronic device front screen 212A are hidden and unusable. In the compact form, the exposed screens 208A, 212B are not on the same plane and do not form a double-sized screen.

Figure 7D:
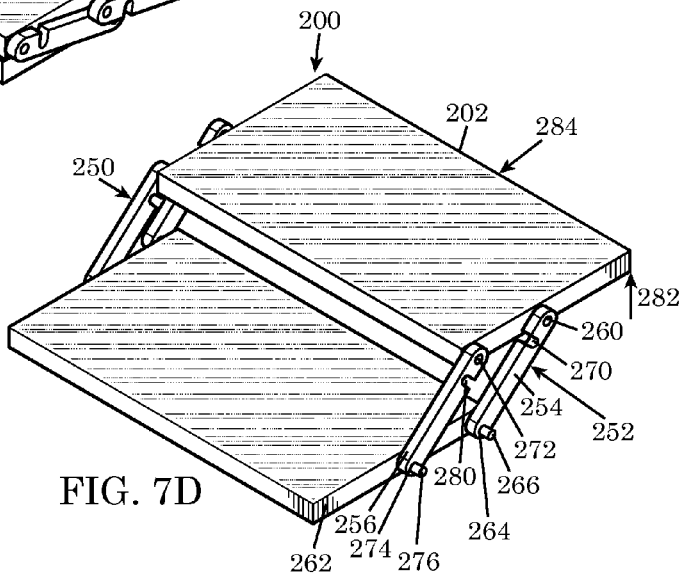
FIG. 7D is a perspective view of a multi-screen electronic device being transformed from an expanded form to a compact form.

In FIG. 7D, the multi-screen electronic device 200 is being transformed from the expanded form to the compact form. The translation mechanism that enables this transformation includes a pair of double-linkage mechanisms 250, 252, each of which couples the primary electronic device 202 to the secondary electronic device 204. The pair of double-linkage mechanisms 250, 252 are on opposite sides of the multi-screen electronic device 200 and are parallel to each other. By this parallel arrangement, the pair of double-linkage mechanisms 250, 252 keep the primary and secondary electronic devices 202, 204 parallel to each other at all times. The double-linkage mechanisms 250, 252 are identical. As such, only one of the double-linkage mechanisms 250, 252 will be described below in detail.

The double-linkage mechanism 250 includes a pair of linkages 254, 256. Linkage 254 is coupled to a side 258 of the primary electronic device 202 through rotary joint 260 and to a side 262 of the secondary electronic device 204 through rotary joint 264. The rotary joint 264 includes a lug 266. Linkage 254 has a detent 270. Similarly, linkage 256 is coupled to the side 258 of the primary electronic device body 206 through rotary joint 272 and to the side 262 of the secondary electronic device body 210 through rotary joint 274. The rotary joint 274 includes a lug 276. Linkage 256 has a detent 280. The detent 280 on linkage 256 engages the lug 266 on linkage 254 when the multi-screen electronic device 200 is in the expanded form. The detent 270 on linkage 254 engages the lug 276 when the multi-screen electronic device 200 is in the compact form. The detent and lugs are used to secure or lock the primary and secondary electronic devices 202, 204 together when the multi-screen electronic device 200 is in the expanded form or compact form. Electrical wiring for electrical connection between the primary and secondary electronic devices 202, 204 may be housed within the linkages 254, 256. Alternatively, each of the primary and secondary electronic devices 202, 204 may have its own source of power, and the primary and secondary electronic devices 202, 204 may communicate wirelessly with each other.

To transform the multi-screen electronic device 200 from the expanded form to the compact form, the primary electronic device 202 is raised up from the secondary electronic device 204, in the direction indicated by the arrow 282, and then moved laterally over the secondary electronic device 204, in the direction indicated by the arrow 284. During this transition, the linkages 254, 256 rotate in between the primary and secondary electronic devices 202, 204 along a nonlinear path and the detent 280 on linkage 256 separates from the lug 266 on linkage 254. At the end of the transformation, the primary electronic device 202, 204 fully overlaps the secondary electronic device 204 and is locked to the secondary electronic device by engagement of the detent 270 on linkage 254 with the lug 276 on linkage 256. The reverse of the process described above can be used to transform the multi-screen electronic device 200 from the compact form to the expanded form. That is, the primary electronic device 202 will be raised up from the secondary electronic device 204 and then moved laterally from over the secondary electronic device 204 until the primary electronic device 202 is beside the secondary electronic device 204 and locked onto the secondary electronic device 204 by engagement of the detent 280 with the lug 266.

Figure 8A:
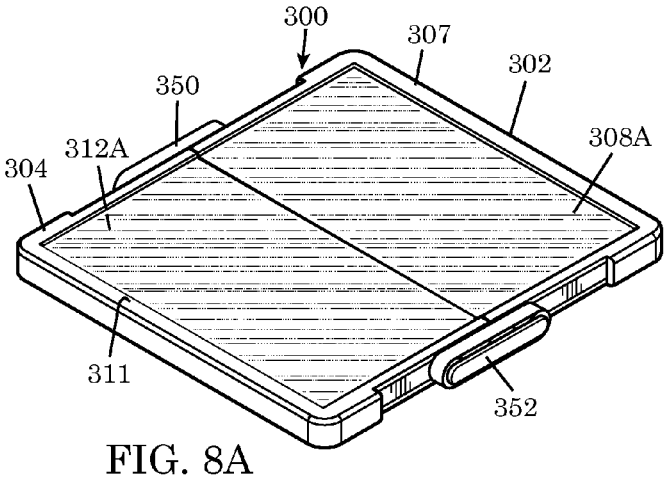
FIG. 8A is a perspective view of a frontside of a multi-screen electronic device in an expanded form.
Figure 8B:
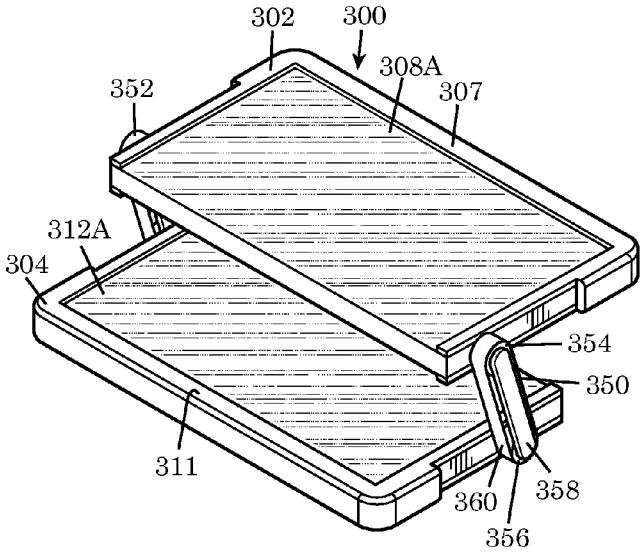
FIG. 8B is a perspective view of a multi-screen electronic device being transformed from an expanded form to a compact form.
Figure 8C:
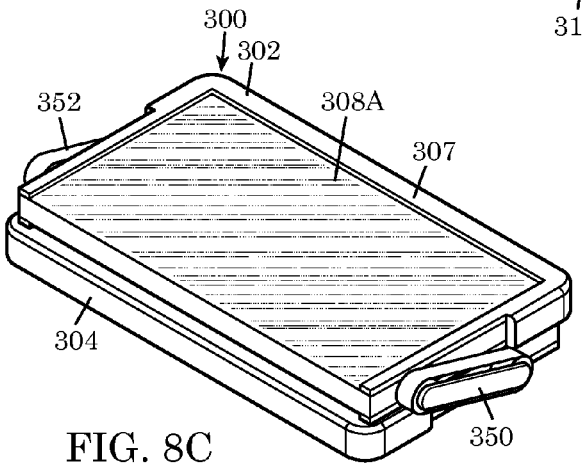
FIG. 8C is a perspective view of a frontside of a multi-screen electronic device in a compact form.

FIGS. 8A-8C show a multi-screen electronic device 300 according to another embodiment of the invention. The multi-screen electronic device 300 is similar to the previously described multi-screen electronic device 200 (in FIGS. 7A-7D) in many respects. In FIG. 8A, the multi-screen electronic device 300 has a primary electronic device 302 and a secondary electronic device 304. The primary electronic device 302 has a primary electronic device front screen 308A. The primary electronic device 302 also has a primary electronic device back screen, but this back screen is not visible in FIG. 8A because of the view of the multi-screen electronic device 300 shown in FIG. 8A. The secondary electronic device 304 has a secondary electronic device front screen 312A. The secondary electronic device 304 also has a secondary electronic device back screen, but this back screen is not visible in FIG. 8A because of the view of the multi-screen electronic device 300 shown in FIG. 8A.

The multi-screen electronic device 300 has a compact form, as shown in FIG. 8C, in which the primary and secondary electronic devices 302, 304 are stacked. In this compact form, the primary electronic device front screen 308A and the secondary electronic device back screen (which is on the backside of the secondary electronic device 304) are exposed and usable, and the primary electronic device back screen (which is on the backside of the primary electronic device 302) and the secondary electronic device front screen 312A are hidden and unusable. The multi-screen electronic device 300 has an expanded form, as shown in FIG. 8A, in which the primary and secondary electronic devices 302, 304 are unstacked and all the screens of the primary and secondary electronic devices 302, 304 are exposed and usable. In this expanded form, the front screens 308A, 312A form a double-sized screen and the back screens form a double-sized screen (the back screens are located on the backside of the multi-screen electronic device 300).

The multi-screen electronic device 300 differs from the previously described multi-screen electronic device 200 in that a protective edge band 307 is provided around the outer edges (top, bottom, and right side) of the primary electronic device 302 in order to protect the edges of the screens of the primary electronic device 302. Also, a protective edge band 311 is provided around the outer edges (top, bottom, and left side) of the secondary electronic device 302 in order to protect the edges of the screens of the secondary electronic device 304. The protective edge bands do not extend to the inner edge (left side) of the primary electronic device 302 and the inner edge (right side) of the secondary electronic device 302. This is to allow the inner edges to abut each other so that the screens of the primary and secondary electronic devices 302, 304 can form double-sized screens when the multi-screen electronic device 300 is in the expanded form, as shown in FIG. 8A. Later, protective edge bands that can extend to the inner edges of the primary and secondary electronic devices 302, 304 and still allow doublesized screens to be formed when the multi-screen electronic device is in the expanded form will be described.

The multi-screen electronic device 300 also differs from the previously described multi-screen electronic device 200 in the translation mechanism that is operable to transform the multi-screen electronic device 300 from the compact form to the expanded form or from the expanded form to the compact form. The translation mechanism that enables transformation of the multi-screen electronic device 300 from the expanded form to the compact form, or vice versa, includes a pair of pulley systems 350, 352, each of which is straddled between and coupled to the primary and secondary electronic devices 302 and 304. The pulley systems 350, 352 engage opposite sides of the multi-screen electronic device 300. The pulley systems 350, 352 are parallel to each other. The pulley systems 350, 352 are identical. As such, only one of the pulley systems 350, 352 will be described below in more detail.

In FIG. 8B, the multi-screen electronic device 300 is being transformed from the expanded form to the compact form, and the pulley system 350 is slanted relative to the primary and secondary electronic devices 302, 304. This is to be contrasted with, for example, the expanded form of the multi-screen electronic device 300 shown in FIG. 8A where the pulley system 350 is parallel to the primary and secondary electronic devices 302, 304. In FIG. 8B, the pulley system 350 includes a pair of wheels 354, 356. The wheel 354 is coupled to the primary electronic device 302 via a rotary joint, and the wheel 356 is coupled to the secondary electronic device 304 via a rotary joint. A rigid arm 358 has one end coupled to the wheel 354 and another end coupled to the wheel 356. By its rigidity, the arm 358 maintains a certain distance between the two wheels 354, 356 throughout the entire motion of the pulley system 350. A belt 360 is looped over the wheels 354, 356 and applies tension to the wheels 354, 356 and arm 358 to maintain the rigidity of the link provided by the pulley system 350 between the primary and secondary electronic devices 302.

Figure 9A:
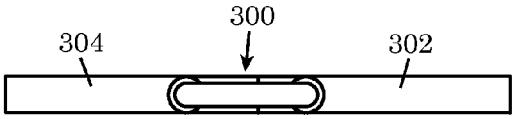
FIGS. 9A-9F is a sequence of motions of a multi-screen electronic device as it is transformed from an expanded form to a compact form.
Figure 9B:
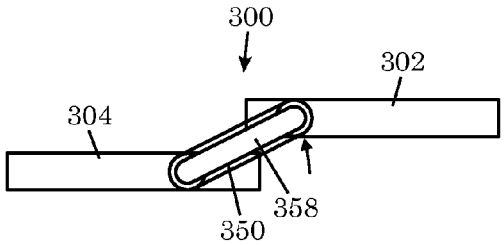
Figure 9C:
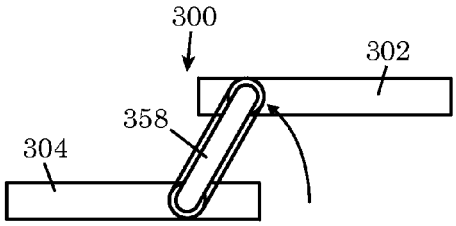
Figure 9D:
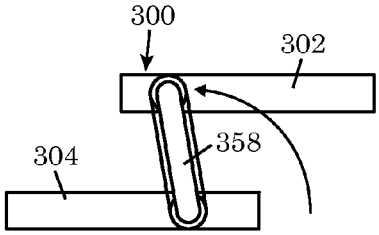
Figure 9E:
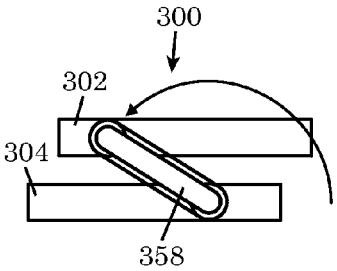
Figure 9F:
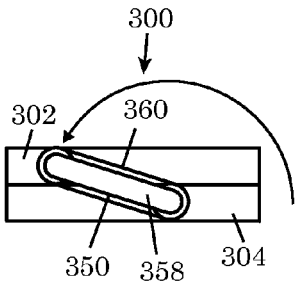

FIGS. 9A-9F show the range of motions as the multi-screen electronic device 300 is transformed from the expanded form to the compact form. In FIG. 9A, the multi-screen electronic device 300 is in the expanded form. In FIGS. 9B and 9C, the primary electronic device 302 is elevated relative to the secondary electronic device 304, which results in the rigid arm 358 rotating and tracing an arc. In FIGS. 9D and 9E, the primary electronic device 302 is moved over the secondary electronic device 304. The rigid arm 358 continues to rotate and trace an arc during this motion. Finally, as shown in FIG. 9F, the primary electronic device 302 fully overlaps and is stacked on top of the secondary electronic device 304. This is the compact form. The pulley system 350, by the rigidity of the link it provides between the primary and secondary electronic devices 302, 304, holds the primary and secondary electronic devices 302, 304 parallel through the entire sequence of motion. The reverse of the sequence shown in FIGS. 9A-9F can be used to transform the multi-screen electronic device 300 from the compact form to the expanded form. The tension provided by the belt 360 of the pulley system 350 maintains the multi-screen electronic device 300 in the compact form or the expanded form until the pulley system 350 is again activated.

Figure 10A:
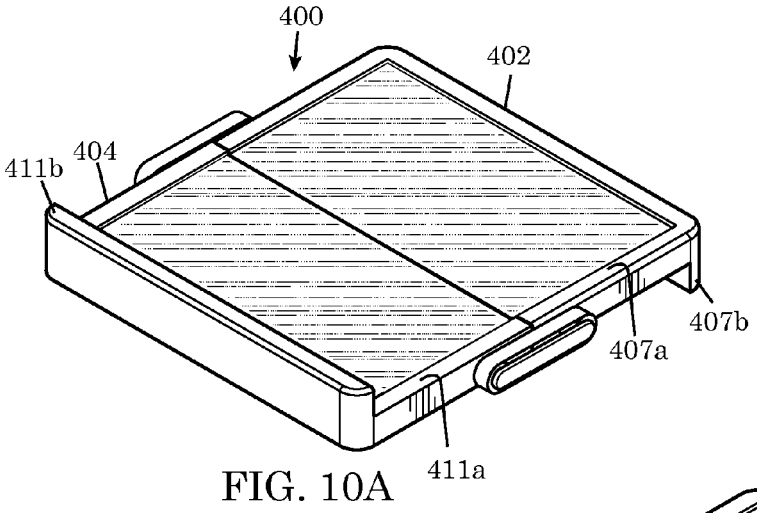
FIG. 10A is a perspective view of a frontside of a multi-screen electronic device in an expanded form.
Figure 10B:
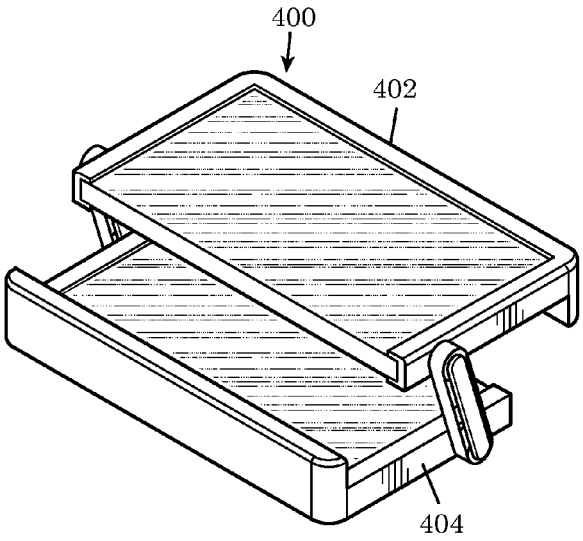
FIG. 10B is a perspective view of a frontside of a multi-screen electronic device in a compact form
Figure 10C:
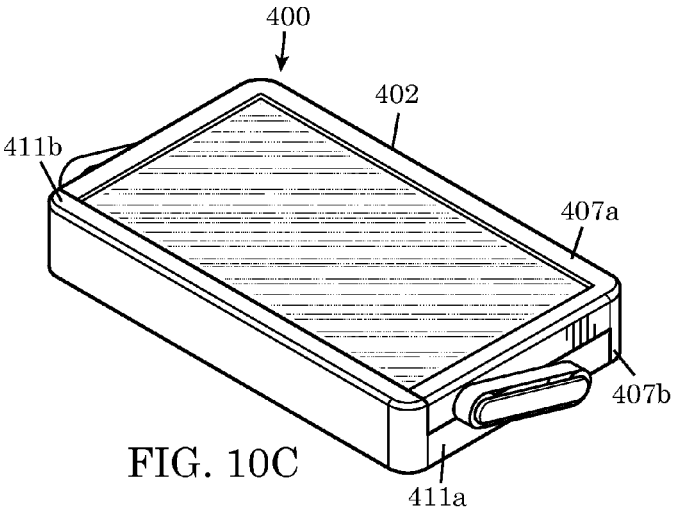
FIG. 10C is a perspective view of a multi-screen electronic device being transformed from an expanded form to a compact form.

FIGS. 10A-10C show a multi-screen electronic device 400 that is similar to the multi-screen device 300 in nearly all respects, except for the manner in which the edges of the primary and secondary electronic devices 402, 404 are protected. In FIG. 10A, a protective edge band 407*a* is provided around the top, right side, and bottom edges of the primary electronic device 402. The protective edge band 407*a* has a protruding lip 407*b* at the backside of the primary electronic device 402. As shown in FIG. 10C, the lip 407*b* abuts the inner edge of the secondary electronic device 404 when the multi-screen electronic device 400 is in the compact form, thereby offering protection to the inner edge of the secondary electronic device 404. In FIG. 10A, a protective edge band 411*a* is provided around the top, left side, and bottom edges of the secondary electronic device 404. The protective edge band 411*a* has a protruding lip 411*b* at the frontside of the secondary electronic device 404. As shown in FIG. 10C, the lip 411*b* abuts an inner edge of the primary electronic device 402 when the multi-screen electronic device 400 is in the compact form, thereby offering protection to the inner edge of the primary electronic device 402. FIG. 10B shows the multi-screen electronic device 400 as it is transformed from the expanded form to the compact form. All other aspects of the multi-screen electronic device 400 may be gleaned from the description of the multi-screen electronic device 300.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A multi-screen electronic device, comprising:

a first electronic device having a first electronic device screen and a first electronic device body, the first electronic device screen being mounted on a frontside of the first electronic device body, the first screen electronic device further comprising an additional first electronic device screen mounted on a backside of the first electronic device body;

a second electronic device having a second electronic device screen and a second electronic device body, the second electronic device screen being mounted on a frontside of the second electronic device body, the first and second electronic screens being stacked and on different planes when the multi-screen electronic device is in a compact form, the first and second electronic screens being unstacked and on the same plane when the multi-screen electronic device is in an expanded form; and a translation mechanism coupled to the first and second electronic devices, the translation mechanism being configured to guide a motion of at least one of the first and second electronic devices along a nonlinear path such that a travel along the nonlinear path in a forward direction transforms the multi-screen electronic device from the compact form to the expanded form and a travel along the nonlinear path in a reverse direction transforms the multi-screen electronic device from the expanded form to the compact form, wherein the translation mechanism is a sliding mechanism comprising a guide channel formed in the first electronic body and a guide tab formed on the second electronic device body, the guide tab being adapted to slide along the guide channel, wherein the guide channel defines the nonlinear path and has three guide channel portions providing three different motion directions.

2. The multi-screen electronic device of claim 1, wherein the second electronic device further comprises an additional second electronic device screen mounted on a backside of the second electronic device body.

3. The multi-screen electronic device of claim 2, wherein the additional first and second electronic device screens are stacked and on different planes when the multi-screen electronic device is in the compact form, and wherein the additional first and second electronic device screens are unstacked and on the same plane when the multi-screen electronic device is in the expanded form.

4. The multi-screen electronic device of claim 3, wherein the additional first and second electronic device screens provide a double-sized screen when the multi-screen electronic device is in the expanded form.

5. The multi-screen electronic device of claim 1, wherein the first and second electronic device screens provide a double-sized screen when the multi-screen electronic device is in the expanded form.

6. The multi-screen electronic device of claim 1, wherein the first electronic device body has a recess for receiving the second electronic device when the multi-screen electronic device is in the compact form.

7. The multi-screen electronic device of claim 1, further comprising a port formed on one of the first and second electronic devices and a connector formed on the other of the first and second electronic devices, the port and connector being adapted to mate to form at least one of a data connection and power connection between the first and second electronic devices when the multi-screen electronic device is in the expanded form.

8. The multi-screen electronic device of claim 1, wherein each of the first and second electronic device screens is selected from the group consisting of a display screen, an input screen, a touch screen, and any combination of the preceding.

9. A multi-screen electronic device, comprising:

a first electronic device having a first electronic device screen and a first electronic device body, the first electronic device screen being mounted on a frontside of the first electronic device body;

a second electronic device having a second electronic device screen and a second electronic device body, the second electronic device screen being mounted on a frontside of the second electronic device body, the first and second electronic screens being stacked and on different planes when the multi-screen electronic device is in a compact form, the first and second electronic screens being unstacked and on the same plane when the multi-screen electronic device is in an expanded form; and a translation mechanism coupled to the first and second electronic devices, the translation mechanism being configured to guide a motion of at least one of the first and second electronic devices along a nonlinear path such that a travel along the nonlinear path in a forward direction transforms the multi-screen electronic device from the compact form to the expanded form and a travel along the nonlinear path in a reverse direction transforms the multi-screen electronic device from the expanded form to the compact form, wherein the translation mechanism is a pivoting mechanism, wherein the pivoting mechanism comprises a pair of parallel linkages and each linkage is coupled to a side of each of the first and second electronic device bodies via rotary joints, and wherein the pivoting mechanism further comprises means for locking the pair of parallel linkages together when the multi-screen electronic device is in the compact form or expanded form.

10. The multi-screen electronic device of claim 9, wherein the pivoting mechanism comprises an additional pair of parallel linkages and each additional linkage is coupled to another side of each of the first and second electronic device bodies via rotary joints.

11. The multi-screen electronic device of claim 10, wherein the pivoting mechanism further comprises means for locking the additional pair of linkages together when the multi-screen electronic device is in the compact form or expanded form.

12. The multi-screen electronic device of claim 9, wherein the first electronic device further comprises an additional first electronic device screen mounted on a backside of the first electronic device body, and wherein the second electronic device further comprises an additional second electronic device screen mounted on a backside of the second electronic device body.

13. The multi-screen electronic device of claim 12, wherein the additional first and second electronic device screens are stacked and on different planes when the multi-screen electronic device is in the compact form, and wherein the additional first and second electronic device screens are unstacked and on the same plane when the multi-screen electronic device is in the expanded form.

14. A multi-screen electronic device, comprising:

a first electronic device having a first electronic device screen and a first electronic device body, the first electronic device screen being mounted on a frontside of the first electronic device body;

a second electronic device having a second electronic device screen and a second electronic device body, the second electronic device screen being mounted on a frontside of the second electronic device body, the first and second electronic screens being stacked and on different planes when the multi-screen electronic device is in a compact form, the first and second electronic screens being unstacked and on the same plane when the multi-screen electronic device is in an expanded form; and a translation mechanism coupled to the first and second electronic devices, the translation mechanism being configured to guide a motion of at least one of the first and second electronic devices along a nonlinear path such that a travel along the nonlinear path in a forward direction transforms the multi-screen electronic device from the compact form to the expanded form and a travel along the nonlinear path in a reverse direction transforms the multi-screen electronic device from the expanded form to the compact form, wherein the translation mechanism is a pulley mechanism, wherein the pulley mechanism comprises a pair of wheels coupled to a side of the first and second electronic bodies via rotary joints, a rigid arm coupled to and linking the pair of wheels, and a belt looped over the pair of wheels, wherein the rigid arm traces an arc as the multi-screen device is transformed from the compact form to the expanded form or from the expanded form to the compact form.

15. The multi-screen electronic device of claim 14, wherein each of the first and second electronic device screens is selected from the group consisting of a display screen, an input screen, a touch screen, and any combination of the preceding.

16. The multi-screen electronic device of claim 14, wherein the pulley mechanism further comprises an additional pair of wheels coupled to another side of the first and second electronic bodies via rotary joints, an additional rigid arm coupled to and linking the additional pair of wheels, and an additional belt looped over the additional pair of wheels.

17. The multi-screen electronic device of claim 14, wherein the first electronic device further comprises an additional first electronic device screen mounted on a backside of the first electronic device body, and wherein the second electronic device further comprises an additional second electronic device screen mounted on a backside of the second electronic device body.

18. The multi-screen electronic device of claim 17, wherein the additional first and second electronic device screens are stacked and on different planes when the multi-screen electronic device is in the compact form, and wherein the additional first and second electronic device screens are unstacked and on the same plane when the multi-screen electronic device is in the expanded form.

* * * * *